US011196151B2

(12) United States Patent
Ahn et al.

(10) Patent No.: US 11,196,151 B2
(45) Date of Patent: Dec. 7, 2021

(54) ELECTRONIC DEVICE COMPRISING ANTENNA

(71) Applicant: Samsung Electronics Co., Ltd., Gyeonggi-do (KR)

(72) Inventors: Jung Ho Ahn, Seoul (KR); Sang Il Park, Seoul (KR); Bo Ram Namgoong, Gyeonggi-do (KR); Jae Bong Chun, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 24 days.

(21) Appl. No.: 16/632,693

(22) PCT Filed: Aug. 23, 2018

(86) PCT No.: PCT/KR2018/009721
§ 371 (c)(1),
(2) Date: Jan. 21, 2020

(87) PCT Pub. No.: WO2019/039882
PCT Pub. Date: Feb. 28, 2019

(65) Prior Publication Data

US 2020/0144703 A1 May 7, 2020

(30) Foreign Application Priority Data

Aug. 24, 2017 (KR) ..... 10-2017-0106998

(51) Int. Cl.
*H01Q 1/28* (2006.01)
*H01Q 5/30* (2015.01)
(Continued)

(52) U.S. Cl.
CPC ..... *H01Q 1/28* (2013.01); *H01Q 1/241* (2013.01); *H01Q 1/48* (2013.01); *H01Q 5/30* (2015.01); *H01Q 13/10* (2013.01)

(58) Field of Classification Search
CPC ..... H01Q 1/28; H01Q 1/241; H01Q 1/48; H01Q 5/30; H01Q 5/378; H01Q 13/10;
(Continued)

(56) References Cited

U.S. PATENT DOCUMENTS 7,057,564 B2 6/2006 Tsai et al.
7,564,410 B2 6/2009 Lee
(Continued)

FOREIGN PATENT DOCUMENTS

EP 2929589 A1 10/2015
KR 10-2007-0046898 A 5/2007
(Continued)

OTHER PUBLICATIONS

European Search Report dated Jun. 29, 2020.

*Primary Examiner* — Hoang V Nguyen
(74) *Attorney, Agent, or Firm* — Cha & Reiter, LLC

(57) ABSTRACT

An electronic device according to an embodiment of the present invention comprises a first conductive plate; and a second conductive plate which extends from the first conductive plate at a first angle to the first conductive plate, wherein the first conductive plate and the second conductive plate comprise a conductive member which forms a cavity opened in a first direction perpendicular to the first conductive plate; a first radiation unit which is disposed apart from the first conductive plate by a first distance in a first direction; a second radiation unit which is disposed apart from the first conductive plate by a second distance in a second direction opposite to the first direction; at least one wireless communication circuit which feeds electricity to the first radiation unit and the second radiation unit; and a processor which is electrically connected with the wireless communication circuit, the processor can be set to cause the wireless communication circuit to receive a signal of a first frequency having a directivity in the first direction on the
(Continued)

basis of the cavity formed by the first radiation unit and the conductive member, and to receive a second frequency signal on the basis of the coupling of the second radiation unit and at least a portion of the conductive member. In addition, various embodiments understood from the specification may be possible.

16 Claims, 12 Drawing Sheets

(51) Int. Cl.
*H01Q 1/24* (2006.01)
*H01Q 1/48* (2006.01)
*H01Q 13/10* (2006.01)

(58) Field of Classification Search
CPC ..... H01Q 1/38; H01Q 1/3275; H01Q 13/18; H01Q 19/108
See application file for complete search history.

(56) References Cited

U.S. PATENT DOCUMENTS

| | | | |
|---|---|---|---|
| 7,577,398 | B2 | 8/2009 | Judd et al. |
| 8,010,042 | B2 | 8/2011 | Judd et al. |
| 8,269,677 | B2 | 9/2012 | Guterman et al. |
| 8,358,970 | B2 | 1/2013 | Judd et al. |
| 8,630,581 | B2 | 1/2014 | Judd et al. |
| 8,860,619 | B2 | 10/2014 | Nysen |
| 8,963,782 | B2 | 2/2015 | Ayala Vazquez et al. |
| 8,971,796 | B2 | 3/2015 | Judd et al. |
| 9,203,137 | B1 | 12/2015 | Guterman et al. |
| 9,331,390 | B2 | 5/2016 | Petropoulos |
| 9,350,068 | B2 | 5/2016 | Guterman et al. |
| 9,397,387 | B1 | 7/2016 | Guterman et al. |
| 9,450,289 | B2 | 9/2016 | Guterman et al. |
| 9,450,292 | B2 | 9/2016 | Irci et al. |
| 9,455,489 | B2 | 9/2016 | Shiu et al. |
| 9,543,660 | B2 | 1/2017 | Rajagopalan et al. |
| 9,559,406 | B2 | 1/2017 | Guterman et al. |
| 9,653,777 | B2 | 5/2017 | Guterman et al. |
| 9,871,296 | B2 | 1/2018 | Foo |
| 9,972,886 | B2 | 5/2018 | Petropoulos |
| 2006/0044188 | A1 | 3/2006 | Tsai et al. |
| 2008/0007476 | A1 | 1/2008 | Lee |
| 2011/0050508 | A1 | 3/2011 | Guterman et al. |
| 2011/0050509 | A1 | 3/2011 | Ayala Vazquez et al. |
| 2013/0050032 | A1 | 2/2013 | Shiu et al. |
| 2013/0076582 | A1 | 3/2013 | Nysen |
| 2014/0127989 | A1 | 5/2014 | Judd et al. |
| 2014/0361931 | A1 | 12/2014 | Irci et al. |
| 2014/0375502 | A1 | 12/2014 | Foo |
| 2015/0270599 | A1 | 9/2015 | Guterman et al. |
| 2015/0280324 | A1 | 10/2015 | Petropoulos |
| 2016/0104944 | A1 | 4/2016 | Rajagopalan et al. |
| 2016/0261022 | A1 | 9/2016 | Guterman et al. |
| 2017/0222300 | A1 | 8/2017 | Petropoulos |

FOREIGN PATENT DOCUMENTS

| | | | |
|---|---|---|---|
| KR | 10-2008-0005812 | A | 1/2008 |
| KR | 10-1194370 | B1 | 10/2012 |
| WO | 2011-157172 | A2 | 12/2011 |

(a)

(b)

(c)

| | Freq | Gavg | Gpeak | | Gmin | | Dev |
|---|---|---|---|---|---|---|---|
| | MHz | dBi | dBi | deg | dBi | deg | dB |
| 1 | 1552 | -0.95 | 2.77 | 235 | -13.38 | 150 | 16.15 |
| 2 | 1575 | -0.98 | 2.75 | 235 | -14.60 | 155 | 17.35 |

(a)Default

| | Freq | Gavg | Gpeak | | Gmin | | Dev |
|---|---|---|---|---|---|---|---|
| | MHz | dBi | dBi | deg | dBi | deg | dB |
| 1 | 1552 | -0.75 | 5.16 | 95 | -17.47 | 320 | 22.63 |
| 2 | 1575 | -0.90 | 4.87 | 95 | -17.02 | 320 | 21.89 |

(b)CAVITY ANTENNA STRUCTURE

2460MHz

| | Freq | Gavg | Gpeak | | Gmin | | Dev |
|---|---|---|---|---|---|---|---|
| | MHz | dBi | dBi | deg | dBi | deg | dB |
| 1 | 2460 | -2.71 | 2.47 | 90 | -18.67 | 210 | 21.14 |

(a)Default

| | Freq | Gavg | Gpeak | | Gmin | | Dev |
|---|---|---|---|---|---|---|---|
| | MHz | dBi | dBi | deg | dBi | deg | dB |
| 1 | 2460 | -1.54 | 4.17 | 90 | -34.28 | 305 | 31.94 |

(b)USED AS COUPLER

ELECTRONIC DEVICE COMPRISING ANTENNA

CROSS REFERENCE TO RELATED APPLICATIONS

This application is a National Phase Entry of PCT International Application No. PCT/KR2018/009721, which was filed on Aug. 23, 2018, and claims a priority to Korean Patent Application No. 10-2017-0106998, which was filed on Aug. 24, 2017, the contents of which are incorporated herein by reference.

TECHNICAL FIELD

The disclosure relates to a technology on an antenna included in an electronic device.

BACKGROUND ART

An electronic device may communicate with a network using an antenna. The electronic device may have an antenna to communicate with an external device positioned in a specific direction from the electronic device. For example, an unmanned aerial vehicle may have an antenna to make GPS or WiFi communication.

DISCLOSURE

Technical Problem

For example, an unmanned aerial vehicle may have a patch antenna to make GPS communication. However, the patch antenna may have a higher price or a heavier weight. In addition, when a typical embedded antenna (e.g., a monopole antenna, a dipole antenna, or a PIFA antenna) is mounted in the unmanned aerial vehicle, ensuring the performance of the GPS antenna is difficult.

According to embodiment in the disclosure, the electronic device may include a cavity antenna and a different antenna that is able to be coupled to the cavity structure of the cavity antenna.

Technical Solution

According to an embodiment of the disclosure, an electronic device may include a conductive member including a first conductive plate and a second conductive plate extending from the first conductive plate while forming a first angle with the first conductive plate, in which the first conductive plate and the second conductive plate form a cavity, which is open in a first direction perpendicular to the first conductive plate, a first radiation part spaced in the first direction from the first conductive plate by a first distance, a second radiation part spaced in a second direction, which is opposite to the first direction, from the first conductive plate by a second distance, at least one wireless communication circuit to feed power to the first radiation part and the second radiation part, and a processor electrically connected to the wireless communication circuit. The processor may be configured to allow the wireless communication circuit to receive a signal having a first frequency having a directionality in the first direction based on the first radiation part and the cavity formed by the conductive member and to receive a signal having a second frequency signal based on coupling between the second radiation part and at least a portion of the conductive member.

According to an embodiment of the disclosure, an electronic device may include a first conductive plate and a second conductive plate extending from the first conductive plate while forming a first angle with the first conductive plate, in which the first conductive plate and the second conductive plate form a cavity open in the first direction perpendicular to the first conductive plate, a first conductive pattern and a second conductive pattern spaced the first direction from the conductive plate by a first distance, a third conductive pattern and a fourth conductive pattern spaced in the second direction, which is an opposite direction of the first direction, from the first conductive plate, at least one wireless communication circuit to feed power to the first conductive pattern and the third conductive pattern, and a processor electrically connected to the wireless communication circuit. The processor may allow the wireless communication circuit to receive a signal having a first frequency having a directionality in the first direction based on the first conductive pattern and the second conductive pattern, and the cavity formed by the conductive member, and receive a signal having a second frequency based on coupling between the third conductive pattern and the fourth conductive pattern, and at least a portion of the conductive member.

According to an embodiment of the disclosure, the unmanned aerial vehicle may include a housing including a top surface and a bottom surface, at least one communication circuit to make first wireless communication with the first external device, make second wireless communication, positioned inside the housing, or connected to the housing, a plurality of propulsion systems connected to the housing or at least partially embedded in the housing, a navigation circuit to control the plurality of propulsion systems, and an antenna structure positioned between the top surface and the bottom surface inside the housing and electrically connected to the communication circuit. The antenna structure includes a first conductive plate including a first surface facing the top surface and a second surface facing the bottom surface, a second conductive plate to surround the lateral portion of the first conductive plate, a first antenna pattern interposed between the first surface and the top surface and used for the first wireless communication, and a second antenna pattern interposed between the second surface and the bottom surface and used for second wireless communication.

Advantageous Effects

According to embodiments of the disclosure, at least a portion of the cavity structure of the cavity antenna may be coupled with a different antenna.

According to an embodiment of the disclosure, the electronic device may improve the performance of a different antenna by using the cavity structure.

Besides, a variety of effects directly or indirectly understood through the disclosure may be provided.

MODE FOR INVENTION

Figure 1A:
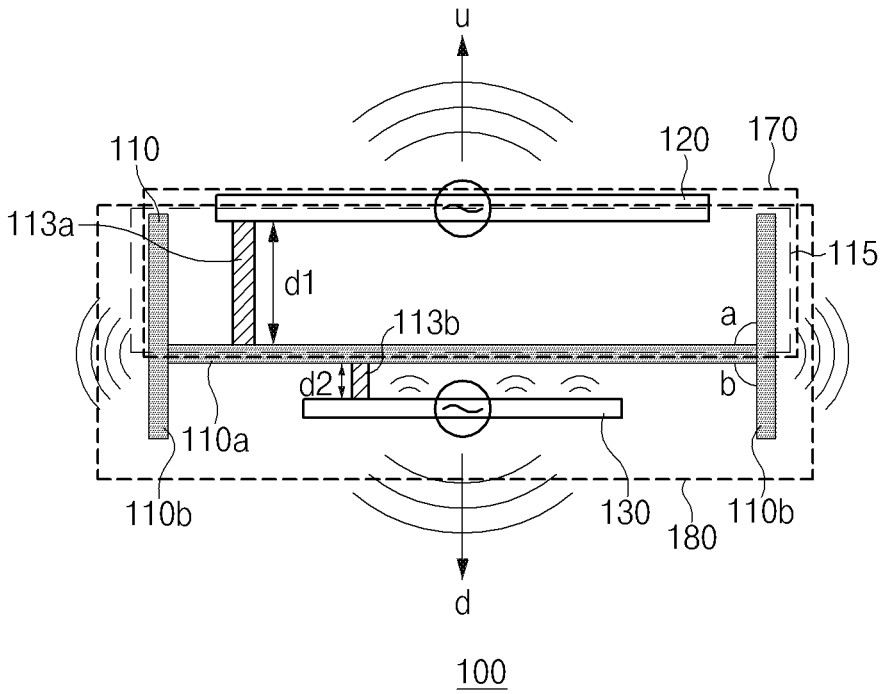
FIG. 1A is a view illustrating the structure of an electronic device, according to an embodiment.

Hereinafter, various embodiments of the disclosure may be described with reference to accompanying drawings. Accordingly, those of ordinary skill in the art will recognize that modification, equivalent, and/or alternative on the various embodiments described herein can be variously made without departing from the scope and spirit of the disclosure. With regard to description of drawings, similar components may be marked by similar reference numerals.

In the disclosure, the expressions "have", "may have", "include" and "comprise", or "may include" and "may comprise" used herein indicate existence of corresponding features (e.g., components such as numeric values, functions, operations, or parts) but do not exclude presence of additional features.

In the disclosure, the expressions "A or B", "at least one of A or/and B", or "one or more of A or/and B", and the like may include any and all combinations of one or more of the associated listed items. For example, the term "A or B", "at least one of A and B", or "at least one of A or B" may refer to all of the case (1) where at least one A is included, the case (2) where at least one B is included, or the case (3) where both of at least one A and at least one B are included.

The terms, such as "first", "second", and the like used in the disclosure may be used to refer to various components regardless of the order and/or the priority and to distinguish the relevant components from other components, but do not limit the components. For example, "a first user device" and "a second user device" indicate different user devices regardless of the order or priority. For example, without departing the scope of the disclosure, a first component may be referred to as a second component, and similarly, a second component may be referred to as a first component.

It will be understood that when a component (e.g., a first component) is referred to as being "(operatively or communicatively) coupled with/to" or "connected to" another component (e.g., a second component), it may be directly coupled with/to or connected to the other component or an intervening component (e.g., a third component) may be present. In contrast, when a component (e.g., a first component) is referred to as being "directly coupled with/to" or "directly connected to" another component (e.g., a second component), it should be understood that there are no intervening component (e.g., a third component).

According to the situation, the expression "configured to" used in the disclosure may be used as, for example, the expression "suitable for", "having the capacity to", "designed to", "adapted to", "made to", or "capable of". The term "configured to" must not mean only "specifically designed to" in hardware. Instead, the expression "a device configured to" may mean that the device is "capable of" operating together with another device or other parts. For example, a "processor configured to (or set to) perform A, B, and C" may mean a dedicated processor (e.g., an embedded processor) for performing a corresponding operation or a generic-purpose processor (e.g., a central processing unit (CPU) or an application processor) which performs corresponding operations by executing one or more software programs which are stored in a memory device.

Terms used in the disclosure are used to describe specified embodiments and are not intended to limit the scope of the disclosure. The terms of a singular form may include plural forms unless otherwise specified. All the terms used herein, which include technical or scientific terms, may have the same meaning that is generally understood by a person skilled in the art. It will be further understood that terms, which are defined in a dictionary and commonly used, should also be interpreted as is customary in the relevant related art and not in an idealized or overly formal unless expressly so defined in various embodiments of the disclosure. In some cases, even if terms are terms which are defined in the disclosure, they may not be interpreted to exclude embodiments of the disclosure.

An electronic device according to various embodiments of the disclosure may include at least one of, for example, smartphones, tablet personal computers (PCs), mobile phones, video telephones, electronic book readers, desktop PCs, laptop PCs, netbook computers, workstations, servers, personal digital assistants (PDAs), portable multimedia players (PMPs), Motion Picture Experts Group (MPEG-1 or MPEG-2) Audio Layer 3 (MP3) players, mobile medical devices, cameras, or wearable devices. According to various embodiments, the wearable device may include at least one of an accessory type (e.g., watches, rings, bracelets, anklets, necklaces, glasses, contact lens, or head-mounted-devices (HMDs)), a fabric or garment-integrated type (e.g., an electronic apparel), a body-attached type (e.g., a skin pad or tattoos), or a bio-implantable type (e.g., an implantable circuit).

According to various embodiments, the electronic device may be a home appliance. The home appliances may include at least one of, for example, televisions (TVs), digital versatile disc (DVD) players, audios, refrigerators, air conditioners, cleaners, ovens, microwave ovens, washing machines, air cleaners, set-top boxes, home automation control panels, security control panels, TV boxes (e.g., Samsung HomeSync™, Apple TV™, or Google TV™), game consoles (e.g., Xbox™ or PlayStation™), electronic dictionaries, electronic keys, camcorders, electronic picture frames, and the like.

According to another embodiment, an electronic device may include at least one of various medical devices (e.g., various portable medical measurement devices (e.g., a blood glucose monitoring device, a heartbeat measuring device, a blood pressure measuring device, a body temperature measuring device, and the like), a magnetic resonance angiography (MRA), a magnetic resonance imaging (MRI), a computed tomography (CT), scanners, and ultrasonic devices), navigation devices, Global Navigation Satellite System (GNSS), event data recorders (EDRs), flight data recorders (FDRs), vehicle infotainment devices, electronic equipment for vessels (e.g., navigation systems and gyrocompasses), avionics, security devices, head units for vehicles, industrial or home robots, automated teller machines (ATMs), points of sales (POSs) of stores, or internet of things (e.g., light bulbs, various sensors, electric or gas meters, sprinkler devices, fire alarms, thermostats, street lamps, toasters, exercise equipment, hot water tanks, heaters, boilers, and the like).

According to an embodiment, the electronic device may include at least one of parts of furniture or buildings/structures, electronic boards, electronic signature receiving devices, projectors, or various measuring instruments (e.g., water meters, electricity meters, gas meters, or wave meters, and the like). According to various embodiments, the electronic device may be one of the above-described devices or a combination thereof. An electronic device according to an embodiment may be a flexible electronic device. Furthermore, an electronic device according to an embodiment of the disclosure may not be limited to the above-described electronic devices and may include other electronic devices and new electronic devices according to the development of technologies.

Hereinafter, electronic devices according to various embodiments will be described with reference to the accompanying drawings. In the disclosure, the term "user" may refer to a person who uses an electronic device or may refer to a device (e.g., an artificial intelligence electronic device) that uses the electronic device.

FIG. 1A is a view illustrating the structure of an electronic device, according to an embodiment.

Referring to FIG. 1A, according to an embodiment, an electronic device 100 may include a conductive member 110, and radiation parts 120 and 130 of an antenna. The antenna radiation parts 120 and 130 may include radiators.

According to an embodiment, the conductive member 110 of the electronic device 100 may include a first conductive plate 110*a* and a second conductive plate 110*b* extending from or connected to the first conductive plate 110*a* while forming a first angle 'a' with the first conductive plate 110*a*. For example, the first conductive plate 110*a* and the second conductive plate 110*b* may form a cavity 115 which is open in a first direction 'u'. For example, the cavity 115 may be referred to as a hole-shaped structure having an opening formed at one side thereof.

According to an embodiment, the electronic device 100 may include the first radiation part 120 disposed to be spaced in the first direction 'u' from the first conductive plate 110*a* by a first distance 'd1'.

According to an embodiment, the electronic device 100 may include the second radiation part 130 disposed to be spaced in a second direction 'd', which is opposite to the first direction 'u', from the first conductive plate 110*a* by a second distance 'd2'.

According to an embodiment, the electronic device 100 may include at least one communication circuit to feed power to the first radiation part 120 and the second radiation part 130. The electronic device 100 may include a processor electrically connected with the wireless communication circuit.

According to an embodiment, the electronic device 100 may include a first antenna 170 (e.g., a GPS antenna) including the first radiation part 120, and the cavity 115 formed by the conductive member 110. The first antenna 170 may transmit or receive a signal having a first frequency having a directionality in the first direction 'u' based on the first radiation part 120, and the cavity 115 formed by the conductive member 110.

According to an embodiment, the cavity 115 may operate as a reflector for the first radiation part 120. The cavity 115 may allow forming the beam pattern of the first radiation part 120 in the first direction 'u'.

According to an embodiment, the electronic device 100 may include a second antenna 180 (e.g., a WiFi antenna) including at least a portion of the conductive member 110 and a second radiation part 130. The conductive member 110 may be coupled to the second radiation part 130. Although FIG. 1A illustrates that the second radiation part 130 is coupled to the entire portion of the conductive member 110, the disclosure is not limited thereto. At least a portion of the conductive member 110 may be coupled to the second radiation part 130.

For example, the electronic device 100 may transmit or receive a third frequency band formed by the conductive member 110, and a fourth frequency band or a fifth frequency band corresponding to a $2^{nd}$ harmonic frequency or a $3^{rd}$ harmonic frequency of the third frequency band, respectively.

According to an embodiment, the second antenna 180 of the electronic device 100 may transmit/receive a 3rd Harmonic Frequency signal of the third frequency band, based on the coupling between the second radiation part 130 and at least a portion of the conductive member 110. The second antenna 180 transmits or receives a signal having a frequency band close to the second frequency, thereby improving the radiation performance and the bandwidth of the second antenna 180.

According to an embodiment, the conductive member 110 may be formed to have a pattern and a length to transmit/receive a frequency adjacent to the band of the second frequency band which is a target frequency.

According to an embodiment, the signal having the first frequency band, which is the resonance frequency band generated from the first radiation part 120, may include a signal of about 1575 Mhz (e.g., GPS frequency). According to an embodiment, the signal having the second frequency band, which is the resonance frequency band generated from the second radiation part 130, may include a signal having the frequency band (e.g., a WiFi frequency) of the range of about 2.4 GHz to 2.5 GHz. As the second radiation part 130 is coupled to the conductive member 110, the signal having the third frequency band generated from the conductive member 110 may include the signal having a 900 MHz band. The signal having the fourth frequency band, which is the $2^{nd}$ harmonic frequency band of the third frequency, may include a signal having a 1.8 GHz band. The signal having the fifth frequency band, which is the $3^{rd}$ harmonic frequency band of the third frequency, may include a signal having the 2.7 GHz band. For example, the electronic device 100 may transmit or receive a signal having the fifth frequency band adjacent to the second frequency through the conductive member 110, and the performance of the second antenna 180 may be improved.

According to an embodiment, the first distance 'd1' may be greater than the second distance 'd2'. For example, as the first distance 'd1', which is the distance from the first conductive plate 110*a* to the first radiation part 120, is reduced, the beam pattern of the first antenna 170 may be narrowed in the first direction 'u'. For example, as the first distance 'd1' is increased, the width of the beam pattern may be increased. For example, the second distance 'd2', which is the distance from the first conductive plate 110*a* to the second radiation part 130, may have a value allowing the coupling between the second radiation part 130 and at least a portion of the conductive member 110.

According to an embodiment, the second antenna 180 of the electronic device 100 may transmit or receive a signal having the second frequency band through at least a portion of the second conductive plate 110*b* of the conductive member 110, which is coupled to the second radiation part 130. For example, at least a portion of the conductive member 110 is coupled to the second radiation part 130 to operate as the radiator of the second antenna 180. The signal having the second frequency band may have a beam pattern facing a left-right direction of the electronic device 100, through the second conductive plate 110*b* of the conductive member 110.

According to various embodiments, the second conductive plate 110*b* of the conductive member 110 may extend in the second direction 'd' from the first conductive plate 110*a* or may be connected with the first conductive plate 110*a* while forming a second angle 'b' with the first conductive plate 110*a*. For example, the second conductive plate 110*b* may operate as a radiator of the second radiation part 130. The radiation performance may be improved in the lateral direction of the second radiation part 130.

According an embodiment, the first radiation part 120 may be coupled to the conductive member 110 through a first support member 113*a*. The second radiation part 130 may be coupled to the conductive member 110 through a second support member 113*b*.

Referring to FIG. 1A, the first support member 113*a* and the second support member 113*b* are illustrated by way of example. However, the shapes of the first support member 113*a* and the second support member 113*b* are not limited thereto. For example, the first support member 113 and the second support member 113*b* may include various support members having a support function to support the first radiation part 120 and the second radiation part 130. For another example, a portion of the conductive member 110 may be deformed to operate as the support member without the first support member 113*a* and the second support member 113*b*.

For example, the first radiation part 120 may be spaced apart from the first conductive plate 110*a* by the first distance 'd1', through the first support member 113*a* and may be coupled to the conductive member 110. For example, the second radiation part 130 may be spaced apart from the first conductive plate 110*a* by the second distance 'd2', through the second support member 113*b* and may be coupled to the conductive member 110.

According to various embodiments, the conductive member 110 may be set to operate as the ground of the first radiation part 120 and the second radiation part 130. The first support member 113*a* and the second support member 113*b* may include a conductive material. The first radiation part 120 and the second radiation part 130 may be electrically conned to the wireless communication circuit through a cable including a power feeding path. The first radiation part 120 and the second radiation part 130 may receive power through the cable.

According to various embodiments, the first radiation part 120 and the second radiation part 130 may be electrically connected to the wireless communication circuit through a cable including a power feeding path and a grounding path. The first support member 113*a* and the second support member 113*b* may include, for example, a non-conductive material.

According to various embodiments, the electronic device 100 may support GPS communication through the first radiation part 120. For another example, the electronic device 100 may support WiFi communication through the second radiation part 130. For example, the second frequency may include 2.4 GHz. The third frequency generated due to the coupling with the conductive member 110 may include 900 MHz. Signals having the fourth frequency, which is the $2^{nd}$ harmonic frequency of the third frequency, and the fifth frequency, which is the $3^{rd}$ harmonic frequency of the third frequency, may be further generated due to the coupling with the conductive member 110. According to an embodiment, as resonances in the third frequency, fourth frequency and the fifth frequency are made, the performance of the WiFi antenna including the second radiation part 130 may be improved. The fourth frequency may include a 2.7 GHz which is the 3rd harmonic frequency of the third frequency. The 2.7 GHz band is close to the band of 2.4 to 2.5 GHz so as to improve the bandwidth of the resonance frequency in a WiFi frequency band.

According to various embodiments, in the electronic device 100, the third frequency band and the fourth frequency band generated based on the coupling between the second radiation part 130 and the at least a portion of the conductive member 110 may support an LTE service band. For example, the conductive member 110 may operate as an element coupled to the WiFi antenna while operating as an LTE antenna.

Figure 1B:
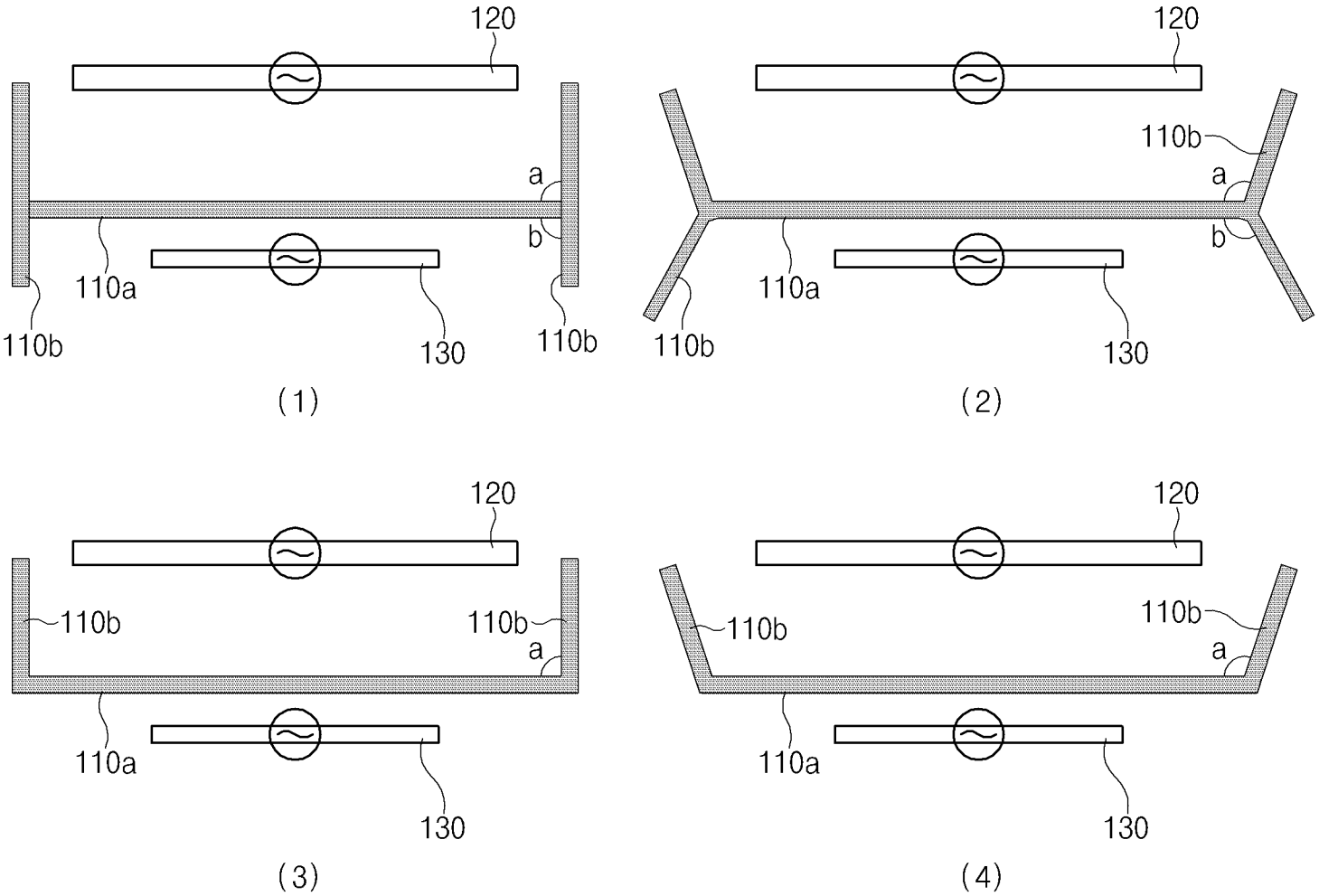
FIG. 1B is a view illustrating the shape of a conductive member, according to various embodiments.

FIG. 1B is a view illustrating the shape of a conductive member, according to various embodiments.

Referring to FIG. 1B, the conductive member 110 may be formed in various shapes.

According to an embodiment, the conductive member 110 may include the first conductive plate 110*a* and the second conductive plate 110*b* extending upward (e.g., the first direction 'u' of FIG. 1A) from the first conductive plate 110*a* while forming a first angle 'a' with the first conductive plate 110*a* or extending downward (e.g., the second direction 'd' of FIG. 1A) from the first conductive plate 110*a* while forming the second angle 'b' with the first conductive plate 110*a*.

For example, the first angle 'a' and the second angle 'b' may be equal to each other or different from each other. A signal transmitted to or received from an antenna including the second radiation part 130 may be varied depending on the first angle 'a' and the second angle 'a'.

Referring to reference numeral (1) of FIG. 1B, according to an embodiment, the first angle 'a' and the second angle 'b' of the conductive member 110 may be formed to be substantially perpendicular to each other. A signal having the second frequency may be transmitted or received in the left-right direction. The sectional view of the conductive member 110 taken in the first direction may have the shape of 'H'.

Referring to reference numeral (2) of FIG. 1B, according to an embodiment, the first angle 'a' and the second angle 'b' of the conductive member 110 may form an obtuse angle therebetween. The radiation pattern of the signal having the second frequency may be changed.

According to an embodiment, the conductive member 110 of the electronic device 100 may include a first conductive plate 110*a* and a second conductive plate 110*b* extending upward (e.g., the direction 'u' of FIG. 1A) from the first conductive plate 110*a* while forming the first angle 'a' with the first conductive plate 110*a*. For example, the second conductive plate 110*b* may not extend downward (e.g., the direction 'd' of FIG. 1A) from the first conductive plate 110*a*. For example, the conductive member 110 may have the shape similar to the shape of 'U' or 'V'.

Referring to reference numeral (3) of FIG. 1B, for example, the first angle 'a' of the conductive member 110 may have a substantially right angle. A signal having the second frequency may be transmitted or received in the left-right direction.

Referring to reference numeral (4) of FIG. 1B, for example, the first angle 'a' of the conductive member 110 may have an obtuse angle. The radiation pattern of the signal having the second frequency may be changed.

According to various embodiments, the first radiation part 120 and the second radiation part 130 of the electronic device 100 may be formed in a PIFA type, an IFA type, a monopole antenna type, or a dipole antenna type. Hereinafter, the first radiation part 120 and the second radiation part 130 formed in the dipole antenna type will be described by way of example, but the disclosure is not limited thereto.

Figure 2A:
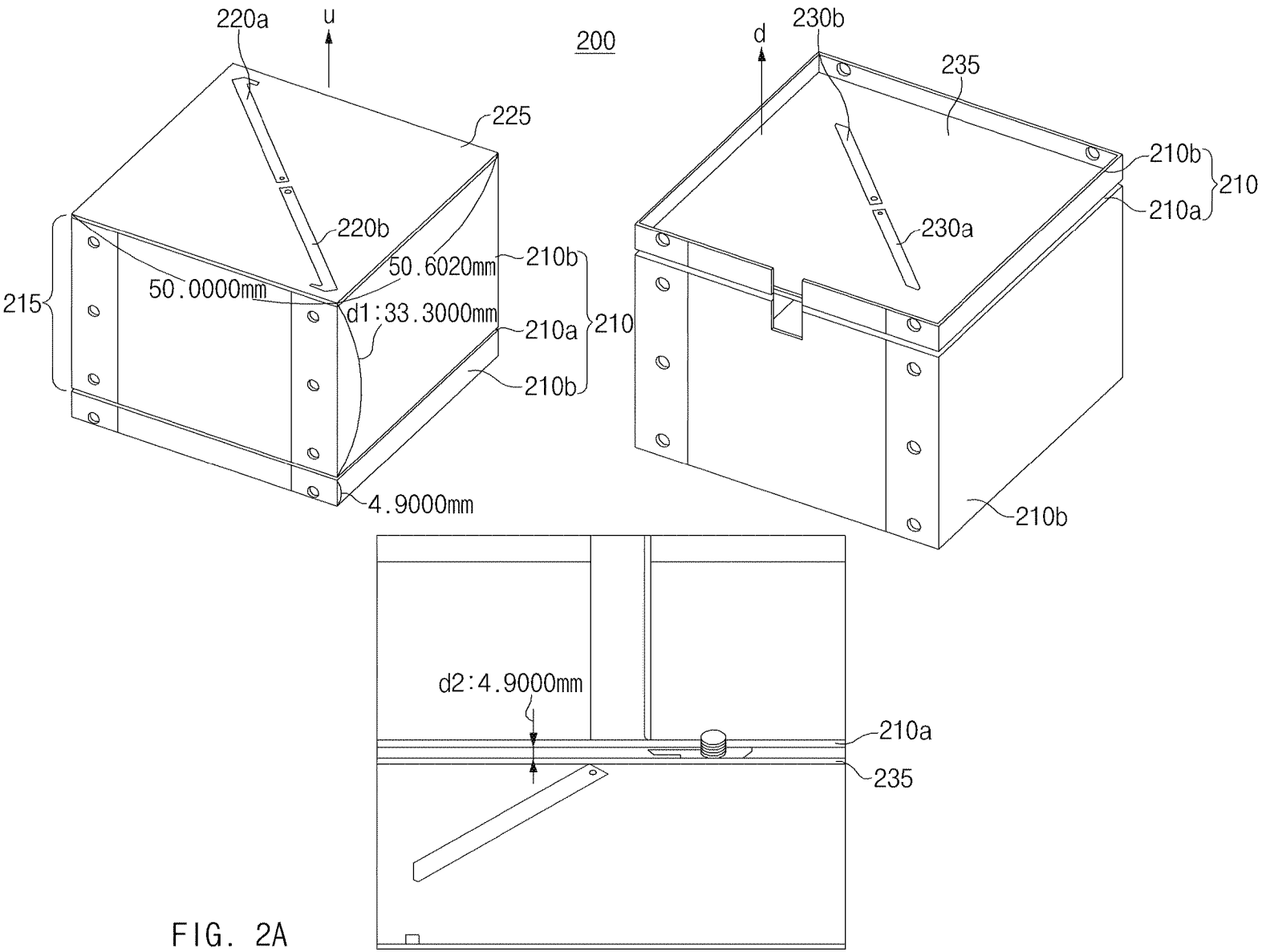
FIG. 2A is a schematic view illustrating an electronic device, according to an embodiment.
Figure 2B:
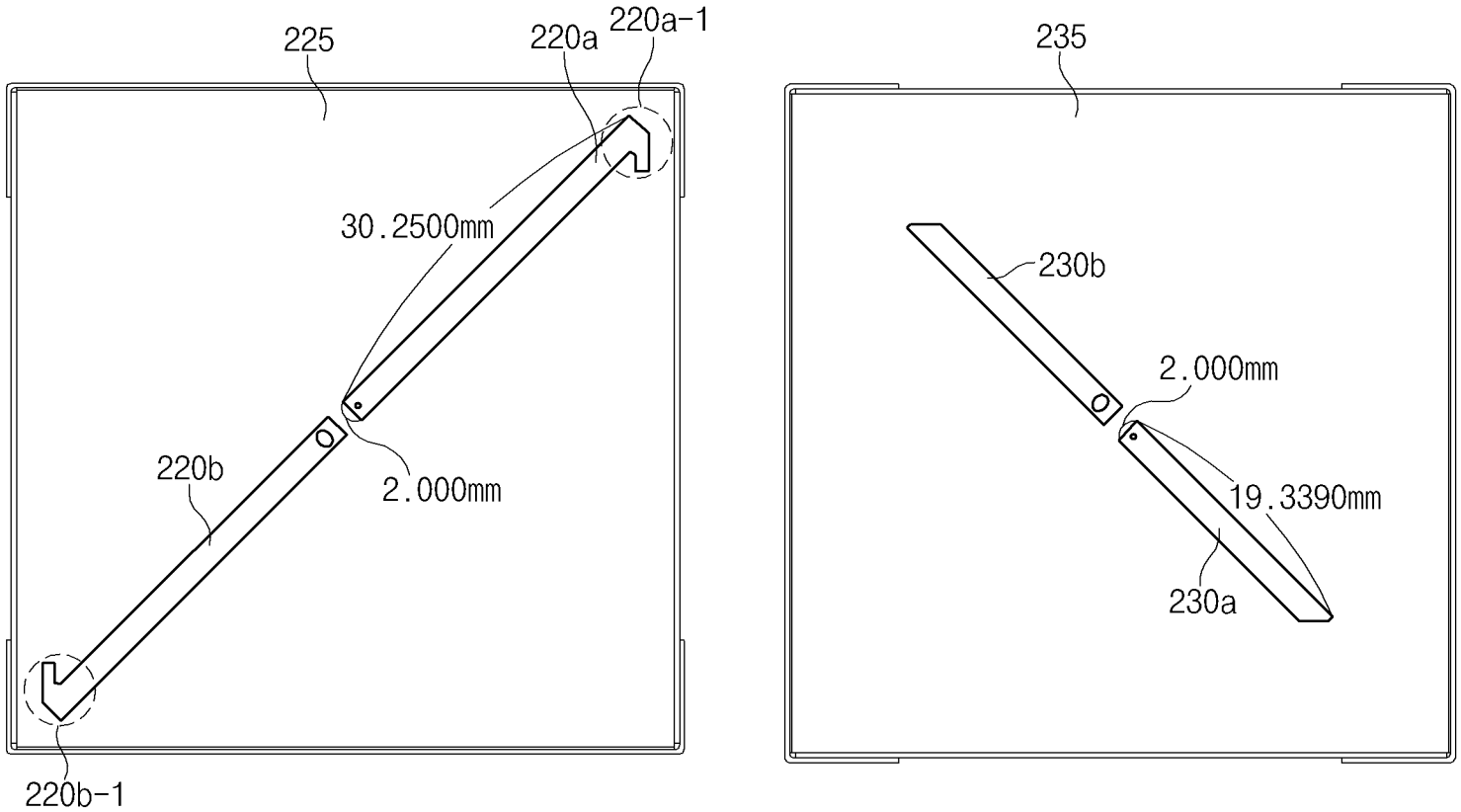
FIG. 2B illustrates a top view and a bottom view of an electronic device, according to an embodiment.
Figure 2C:
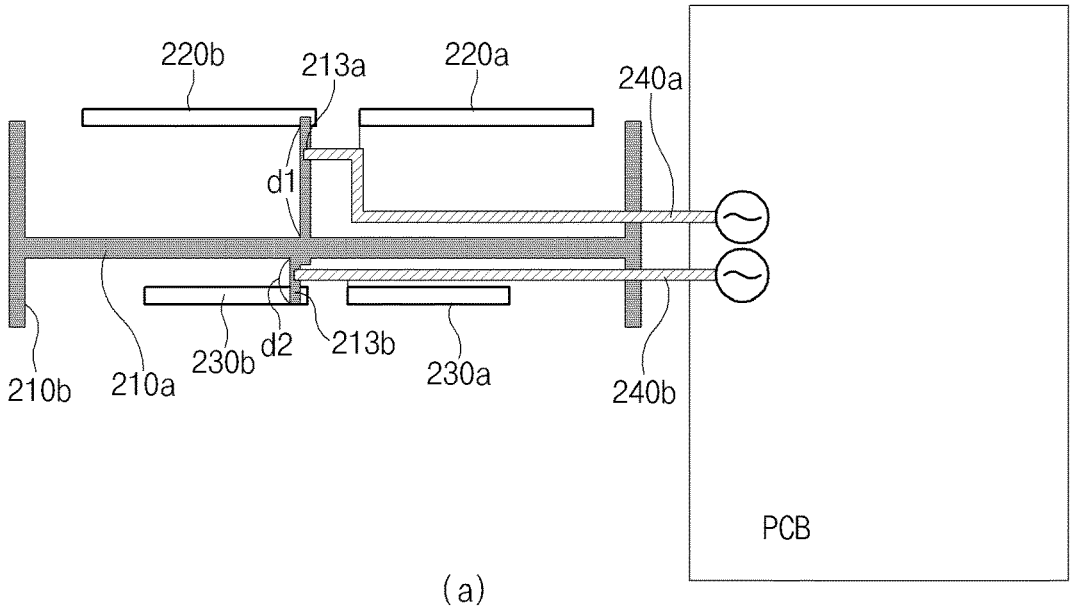
FIG. 2C illustrates a power feeding structure and a grounding structure of an electronic device, according to an embodiment.
Figure 2C:
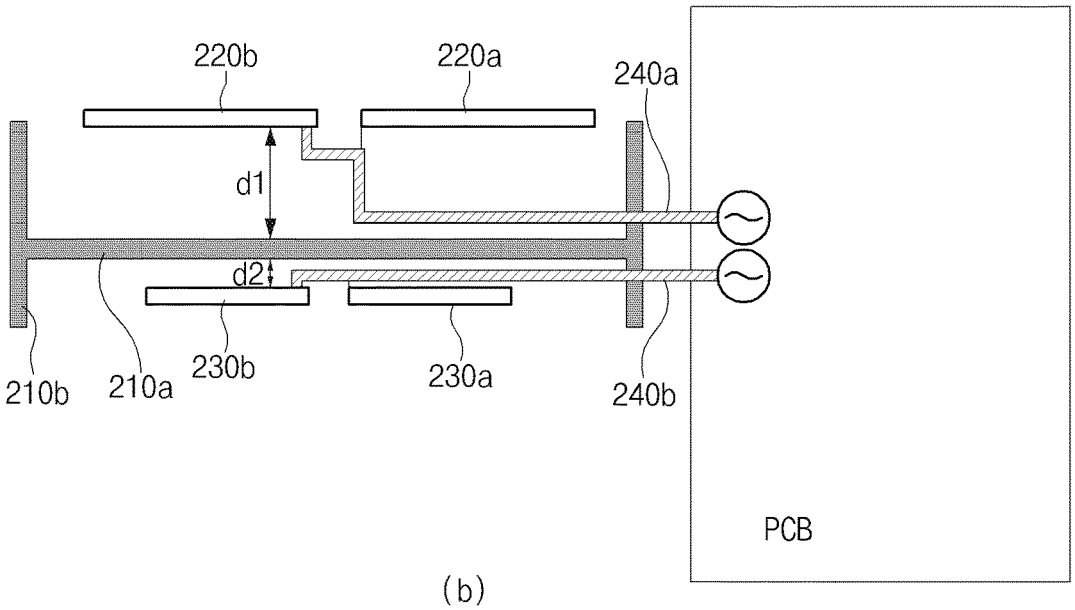
Figure 2C:
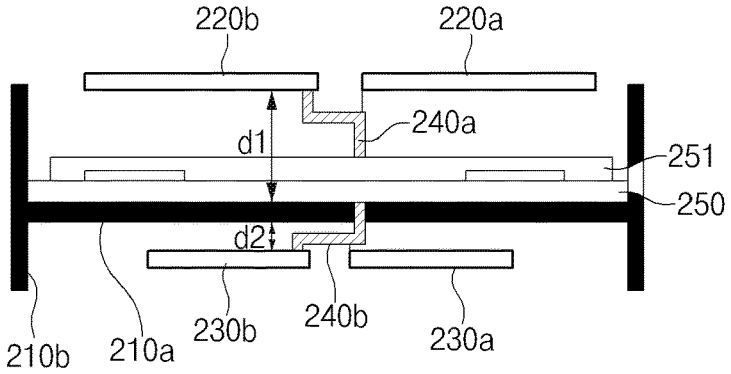
Figure 3A:
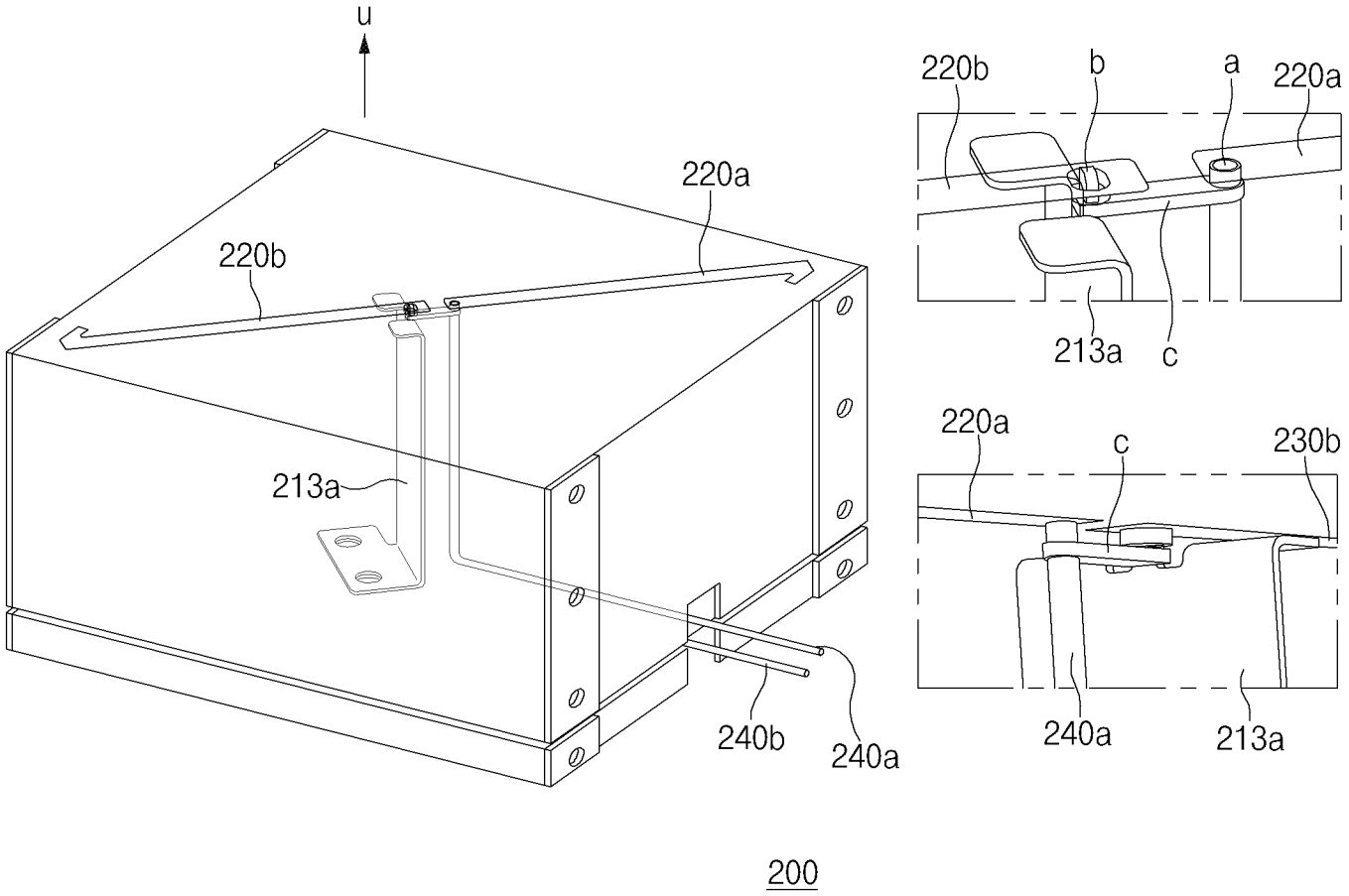
FIGS. 3A and 3B are perspective views of an electronic device, according to an embodiment.
Figure 3B:
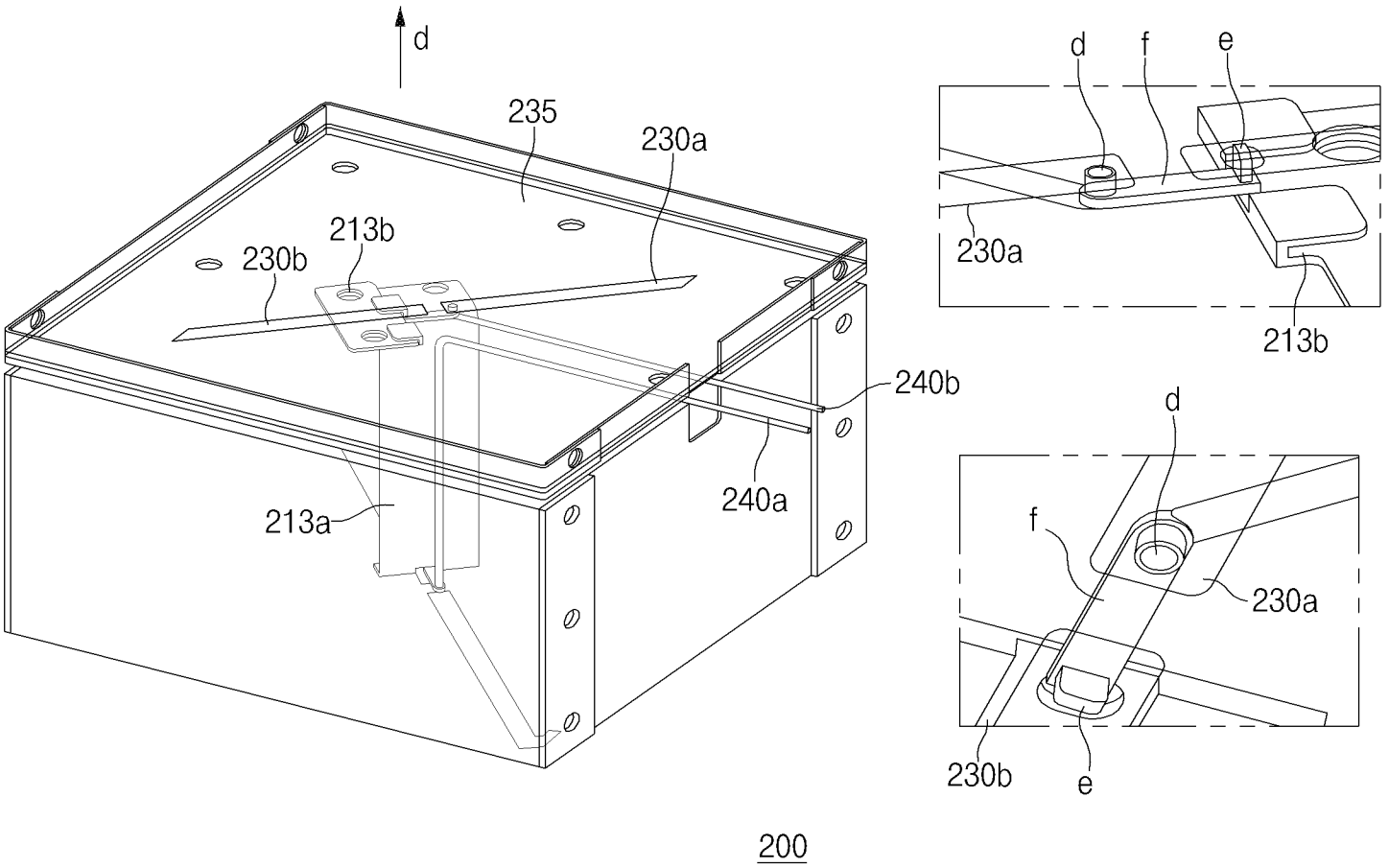

FIG. 2A is a schematic view illustrating an electronic device, according to an embodiment. FIG. 2B illustrates a top view and a bottom view of an electronic device, according to an embodiment. FIG. 2C illustrates a power feeding structure and a grounding structure of an electronic device, according to an embodiment. FIGS. 3A and 3B are perspective views illustrating the electronic device, according to an embodiment.

Referring to FIGS. 2A to 2C, and FIGS. 3A and 3B, an electronic device 200 is provided by way of example. Although a conductive member 210 (e.g., the conductive member 110 of FIG. 1A) in a hexahedral shape is illustrated, the conductive member 210 may include all conductive structures forming a cavity 215.

According to an embodiment, the electronic device 200 (e.g., the electronic device 100 of FIG. 1A) may include a first conductive pattern 220*a* and a second conductive pattern 220*b* spaced in the first direction 'u' (e.g., the first direction 'u' of FIG. 1A) from the first conductive plate 210*a* (e.g., the first surface 110*a* of FIG. 1A) by the first distance 'd1' (e.g., the first distance 'd1' of FIG. 1A).

According to an embodiment, the electronic device 200 may include a third conductive pattern 230*a* and a fourth conductive pattern 230*b* spaced in a second direction 'd' (e.g., the second direction 'd' of FIG. 1A), which is opposite to the first direction, from the first conductive plate 210*a* by the second distance 'd2' (e.g., the second distance 'd2' of FIG. 1A). For example, the first conductive pattern 220*a* and the second conductive pattern 220*b* may be referred to as the radiators of a dipole antenna. For example, the third conductive pattern 230*a* and the fourth conductive pattern 230*b* may be referred to as the radiator of a dipole antenna.

According to an embodiment, the electronic device 200 may include at least one communication circuit to feed power to the first conductive pattern 220*a* and the third conductive pattern 230*a*. The electronic device 200 may include a processor electrically connected with the wireless communication circuit. The second conductive pattern 220*b* and the fourth conductive pattern 230*b* may be connected with the ground. The details thereof will be described later with reference to FIG. 2C.

According to an embodiment, the first antenna (e.g., the first antenna 170 of FIG. 1) may include the first conductive pattern 220*a* and the second conductive pattern 220*b*. The first antenna may be formed to transmit or receive a signal having the first frequency, which has the directionality in the first direction 'u' based on the first conductive pattern 220*a* and the second conductive pattern 220*b*, and the cavity 215 (e.g., the cavity 115 of FIG. 1) formed by the conductive member 210

According to an embodiment, the first antenna (e.g., the first antenna 180 of FIG. 2) may include the third conductive pattern 230*a* and the fourth conductive pattern 230*b*. The second antenna may be formed to transmit or receive a signal having the second frequency, based on the coupling between the third conductive pattern 230*a*, the fourth conductive pattern 230*b*, and at least a portion of the conductive member 210.

According to an embodiment, the first conductive pattern 220*a* and the second conductive pattern 220*b* of the electronic device 200 may be formed on a first non-conductive plane 225 (e.g., the printed circuit board PCB) coupled to the conductive member 210. According to an embodiment, the third conductive pattern 230*a* and the fourth conductive pattern 230*b* of the electronic device 200 may be formed on the second non-conductive plane 235 (e.g., the printed circuit board PCB) coupled to the conductive member 210.

According to an embodiment, the sectional view of the first conductive plate 210*a* and the second conductive plate 210*b* taken in the first direction 'u' may have the shape of 'H'. For example, the conductive member 210 of the electronic device 100 may include the second conductive plate 210*b* extending from or connected to the first conductive plate 210*a* while forming a right angle with the first conductive plate 210*a*. For example, the first conductive plate 210*a* and the second conductive plate 220*b* may form a cavity 215 open in a first direct 'u' perpendicular to the first conductive plate 210*a*.

According to an embodiment, the first non-conductive plane 225 may be disposed at a position corresponding to the opening of the cavity 215. The second non-conductive plane 235 may be disposed to face the first conductive plate 210*a* in the second direction 'd'.

According to various embodiments, the first antenna including the first conductive pattern 220*a* and the second conductive pattern 220*b* may operate as a GPS antenna. The second antenna including the third conductive pattern 230*a* and the fourth conductive pattern 230*b* may operate as a WiFi antenna. Hereinafter, an electronic device 200 including a GPS antenna and a WiFi antenna will be described by way of example. However, the disclosure is not limited thereto, but the electronic device 200 may include a different type of antenna.

According to an embodiment, the first conductive pattern 220*a* and the second conductive pattern 220*b* may include variable areas 220*a*-1 and 220*b*-2. The lengths of the variable areas 220*a*-1 and 220*b*-2 may be adjusted to adjust the resonance frequency generated by the first conductive pattern 220*a* and the second conductive pattern 220*b*. Antennas employing the first conductive pattern 220*a* and the second conductive pattern 220*b* as reflectors may transmit or receive mutually different frequencies depending on the lengths of the variable areas 220*a*-1 and 220*b*-1.

According to an embodiment, the cavity 215 of the conductive member 210 may be formed to have the width of about 50.000 mm, the length of about 50.6020 mm, and the height of about 33.3000 mm. The second conductive plate 210*b* of the conductive member 210 extends about 4.9000 mm in the second direction 'd' from the first conductive plate 210*a* while forming a substantially perpendicular angle with the first conductive plate 210*a*.

According to an embodiment, the first distance 'd1' from the first conductive plate 210*a* to the first conductive pattern 220*a* and the second conductive pattern 220*b* may be greater than the second distance 'd2' from the first conductive plate 210*a* to the third conductive pattern 230*a* and the fourth conductive pattern 230*b*. For example, the first distance 'd1' may be about 33.3000 mm, and the second distance 'd2' may be about 1.6000 mm.

For example, the first conductive pattern 220*a* and the second conductive pattern 220*b* may operate as the radiators of a GPS antenna. The third conductive pattern 230*a* and the fourth conductive pattern 230*b* may operate as radiators of the 2.4 GHz WiFi antenna.

According to an embodiment, the first conductive pattern 220*a* and the second conductive pattern 220*b* are formed in the size of about 2.000 mm×30.2500 mm, and may operate as radiators of a dipole antenna. According to an embodiment, the third conductive pattern 230*a* and the fourth conductive pattern 230*b* are formed in the size of about 2.000 mm×19.3390 mm, and may operate as a radiator of a dipole antenna.

According to an embodiment, the first non-conductive plane 225 may be connected to the conductive member 210 through the first support member 213*a* coupled to the first conductive plate 210*a* in the first direction 'u'. The second non-conductive plane 235 may be connected to the conductive member 210 through the second support member 213*b* coupled to the first conductive plate 210*a* in the second direction 'd'. The first support member 213*a* and the second support member 213*b* may include a conductive material or a non-conductive material.

According to an embodiment, referring to reference numeral (a) of FIG. 2C the conductive member 210 may be set to operate as the ground of the first conductive pattern 220*a* and the second conductive pattern 220*b*. The second conductive pattern 220*b* and the first support member 213*a* may be electrically connected to each other. The fourth conductive pattern 230*b* and the second support member 213*b* may be electrically connected to each other. The first support member 213*a* and the second support member 213*b* may include a conductive material.

According to an embodiment, the first conductive pattern 220*a* and the third conductive pattern 230*a* may be electrically connected to the wireless communication circuit through the cables 240*a* and 240*b* including a power feeding path.

According to another embodiment, referring to reference numeral (b) of FIG. 2C, the first conductive pattern 220*a* may be electrically connected with the wireless communication circuit through the first cable 240*a* including a power feeding path and a grounding path. The first conductive pattern 220*a* may receive power through the first cable 240*a* and the third conductive pattern 230*a* may receive power through the second cable 240*b*. The second conductive pattern 220B may be grounded through the first cable 240*a* and the fourth conductive pattern 230*b* may be grounded through the second cable 240*b*. Although not illustrated, for example, the first support member 213*a* to support the first conductive pattern 220*a* and the second conductive pattern 220*b* and the second support member 213*b* to support the third conductive pattern 230*a* and the fourth conductive pattern 230*b* may include non-conductive materials.

According to an embodiment, the third conductive pattern 230*a* may be electrically connected with the wireless communication circuit through the second cable 240*b* including a power feeding path and a grounding path. The third conductive pattern 230*a* may receive power through the second cable 240*b*. The fourth conductive pattern 230*b* may be grounded through the second cable 240*b*.

According to another embodiment, referring to reference numeral (c) of FIG. 2C, the PCB 250 may be positioned inside the cavity. A communication circuit may be disposed in the PCB 250. For example, the PCB 250 may be disposed on the first conductive plate 210*a* of the conductive member 210. A shield can 251 may be additionally disposed on the PCB to suppress an electromagnetic wave.

Referring to FIGS. 3A and 3B, for example, a point 'a' of the first conductive pattern 220*a* and a point 'd' of the third conductive pattern 230*a* may operate as power feeding points.

According to an embodiment, a point 'b' of the second conductive pattern 220*b* and a point 'e' of the fourth conductive pattern 230*b* may be ground points. The point 'b' of the second conductive pattern 220*b* may be connected through a conductive link 'c' connected to a grounding path included in the first cable 240*a*. The point 'e' of the fourth conductive pattern 230*b* may be connected through a conductive link 'f' connected to a grounding path included in the second cable 240*b*.

According to various embodiments, the first conductive pattern 220*a* to the fourth conductive pattern 230*b* may include at least one slit. As the slit is included, the weight of the electronic device 200 may be reduced. In addition, as the slit is included, the current distribution between the first conductive pattern 220*a* to the fourth conductive pattern 230*b* may be changed, and the radiation pattern and performance may be improved.

Figure 4A:
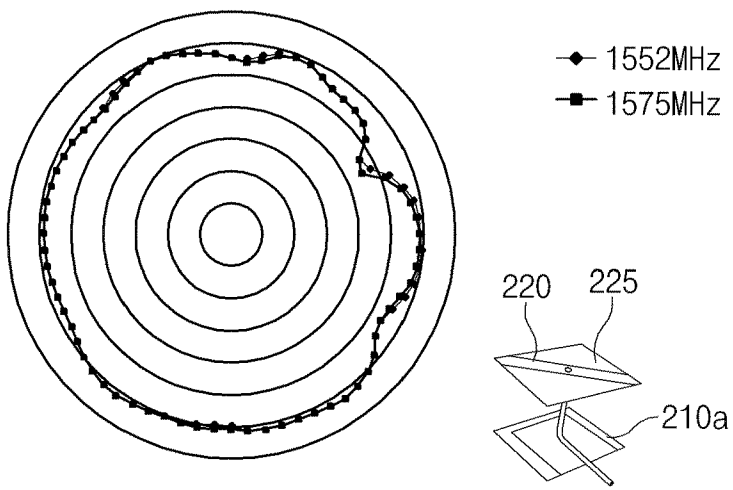
FIG. 4A is a view illustrating the radiation pattern of the GPS antenna, according to an embodiment.
Figure 4A:
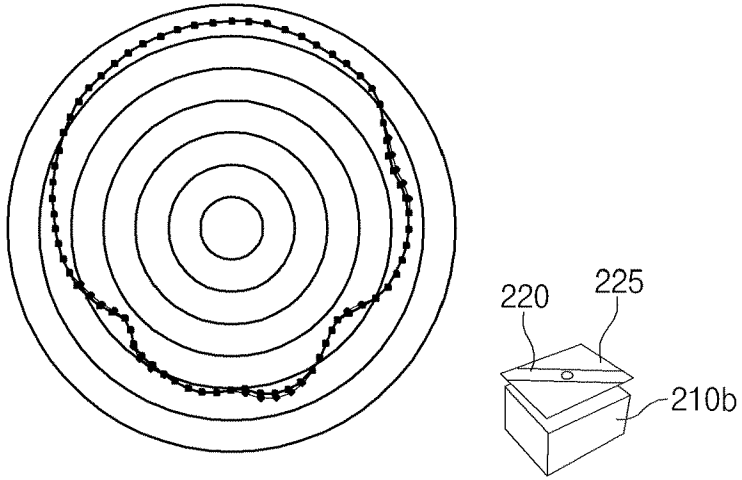
Figure 4B:
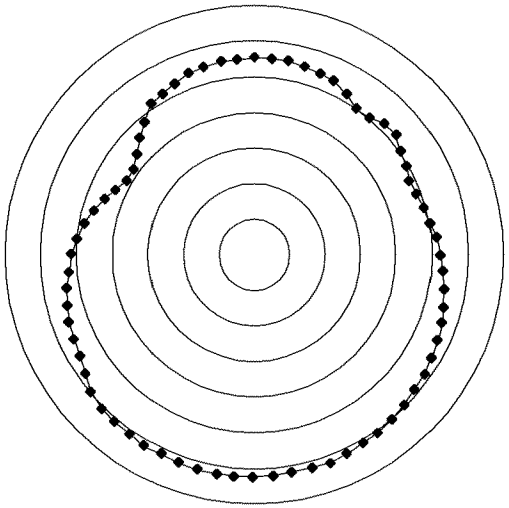
FIG. 4B is a view illustrating a radiation pattern of a WiFi antenna, according to an embodiment.
Figure 4B:
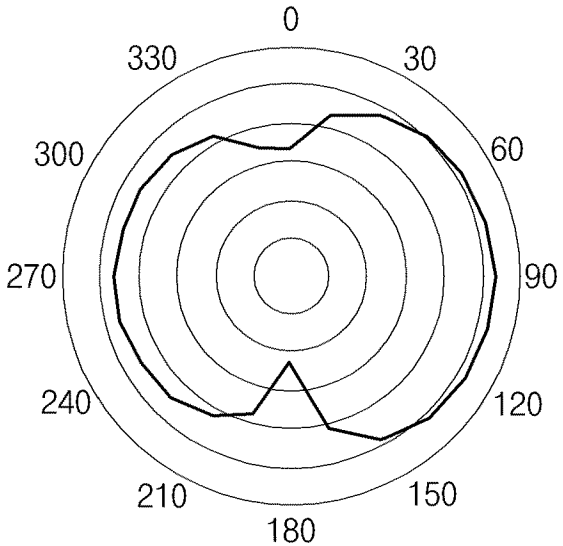

FIG. 4A is a view illustrating the radiation pattern of the GPS antenna, according to an embodiment. FIG. 4B is a view illustrating the radiation pattern of the WiFi antenna, according to an embodiment.

FIGS. 4A and 4B illustrate results obtained by measuring the radiation pattern and performance of the GPS antenna and a 2.5 GHz WiFi antenna of the electronic device 200 illustrated in FIGS. 2A to 3B.

Referring to FIGS. 4A and 4B, reference numeral (a) represents that the conductive member 210 of the electronic device 200 includes the first conductive plate 210*a* without the second conductive plate 210*b* (e.g., the cavity is not formed). Reference numeral (b) represents that the conductive member 210 of the electronic device 200 includes the first conductive plate 210*a* and the second conductive plate 210*b* (e.g., the cavity is formed).

FIG. 4A illustrates the beam antenna and the antenna gain of the GPS antenna (e.g., a GPS antenna including conductive patterns 220*a* and 220*b* of FIG. 2A).

In the case of reference numeral (a), the gain of the GPS antenna was measured as −0.95 dBi based on an average value, and −2.77 dBi based on a peak gain. The radiation pattern has an isotropic form. When the conductive member 210 includes the first conductive plate 210*a*, the effect by the reflective plate is not large.

In the case of reference numeral (b), the gain of the GPS antenna was measured as −0.95 dBi based on an average value, and −2.77 dBi based on a peak gain. The beam pattern was changed upward from the electronic device 200 due to the cavity. The peak gain is increased to +5.16 dBi, that is, increased by the increment of +2.39 dB. When the conductive member 210 includes the first conductive plate 210*a* and the second conductive plate 210*b*, the effect of the reflective plate is increased.

FIG. 4B illustrates the beam pattern and the antenna gain of the WiFi antenna (e.g., a WiFi antenna including conductive patterns 230*a* and 230*b* of FIG. 2A).

In the case of reference numeral (a), the WiFi antenna may be coupled to at least a portion of the first conductive plate 210*a* of the conductive member 210. In the case of reference numeral (b), the WiFi antenna may be coupled to at least a portion of the first conductive plate 210*a* and the second conductive plate 210*b* of the conductive member 210. When compared to reference numeral (a), reference numeral (b) represents that the average gain of the antenna was increased by +1 dB or more, and the peak gain of the antenna was increased by +1.7 dB or more.

In the case of reference numeral (a), the beam pattern of the WiFi represents a pattern radiated downward from the electronic device 200. In the case of reference numeral (b), the beam pattern of the WiFi represents a pattern radiated upward from the electronic device 200. As the second conductive plate 210*b* of the conductive member 210 is coupled to the WiFi antenna, beam patterns may be formed while facing in bi-directions.

Figure 5:
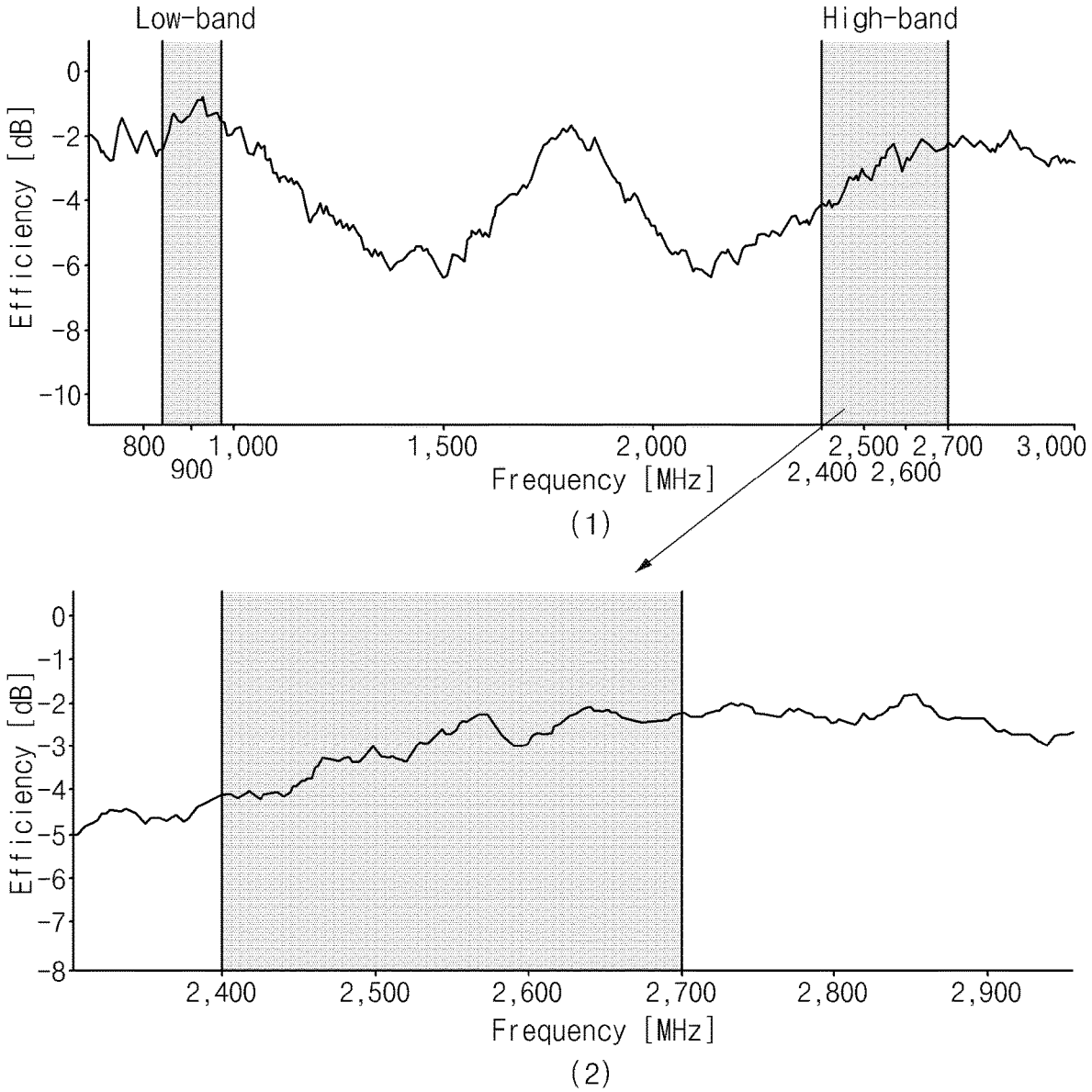
FIG. 5 is a graph illustrating the efficiency of an WiFi antenna, according to an embodiment.

FIG. 5 is a graph illustrating the efficiency of the WiFi antenna, according to an embodiment.

FIG. 5 illustrates the result obtained by measuring the performance of the 2.4 GHz WiFi antenna of the electronic device 200 illustrated in FIGS. 2A to 3B.

FIG. 5 illustrates a graph representing the efficiency of the WiFi antenna when the conductive member 210 of the electronic device 200 includes the first conductive plate 210*a* and the second conductive plate 210*b* (e.g., the cavity is formed).

Multiple resonances occur in the band of about 900 MHz, about 1.8 GHz band, and about 2.4 GHz to 2.7 GHz. A signal having the band of about 900 MHz and a multiplier frequency band thereof may be generated through coupling between the conductive member 210 and the WiFi antenna. The radiation performance of the WiFi antenna may be improved and the bandwidth of the WiFi antenna may be expanded, as the WiFi antenna is coupled to the conductive member 210.

According to an embodiment, the conductive member 210 may separately transmit or receive a signal having a frequency band (e.g., 900 MHz band) different from frequency bands of signals of the GPS antenna and the WiFi antenna. For example, the electronic device 200 may have another antenna (e.g., the LTE antenna) through the conductive member 210.

According to various embodiments, the conductive member 210 may operate as the cavity of the GPS antennal, the coupler of the WiFi antenna, and a radiator of another antenna element.

Figure 6A:
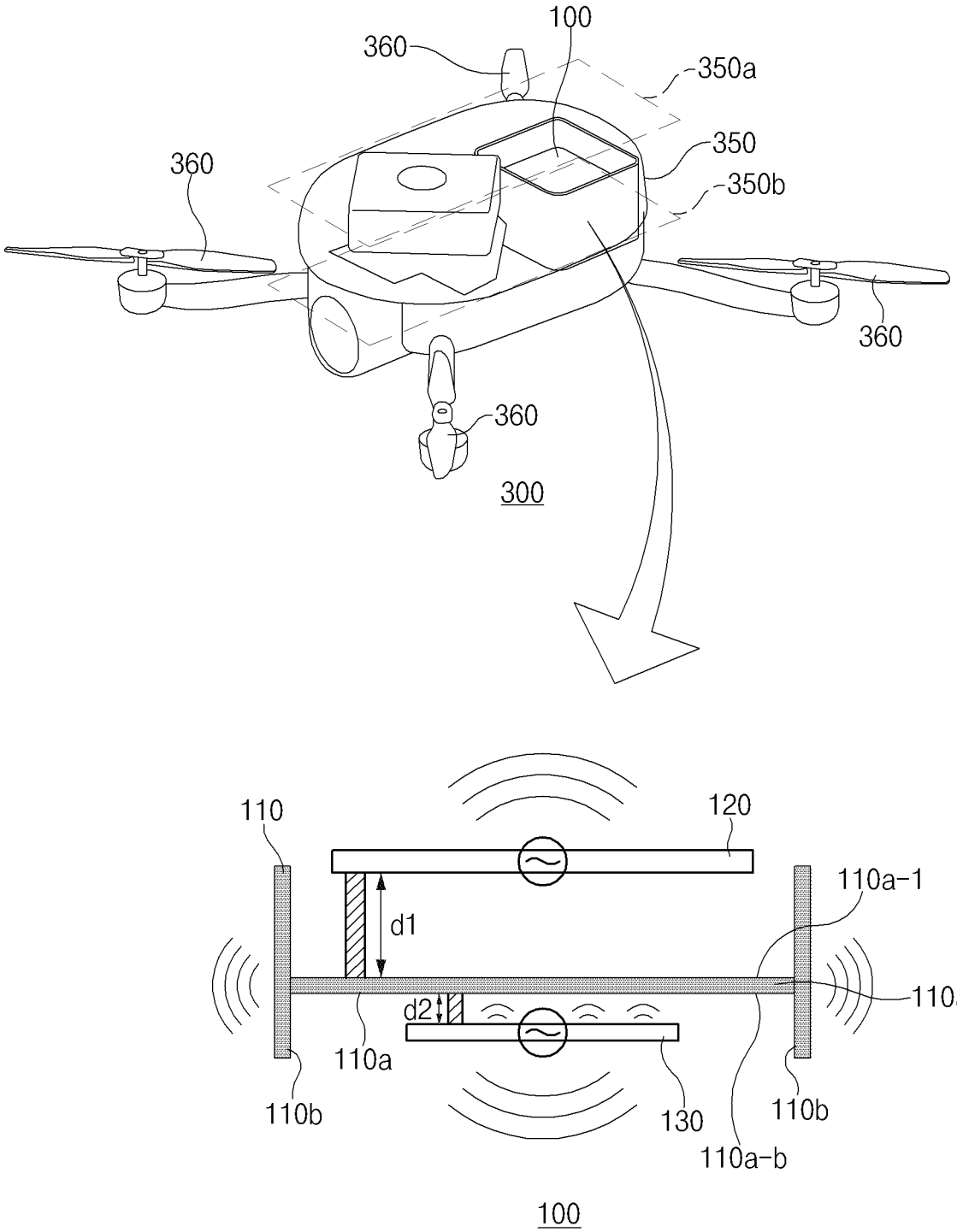
FIG. 6A illustrates an electronic device applied to the unmanned aerial vehicle, according to an embodiment.

FIG. 6A illustrates that the electronic device is applied to the unmanned aerial vehicle, according to an embodiment.

According to an embodiment, the electronic device 100 (e.g. see FIG. 1A) may be mounted in an unmanned aerial vehicle 300. The GPS antenna of the electronic device 100 may form a beam pattern upward of the unmanned aerial vehicle through a cavity structure. A satellite may efficiently communicate with the GPS antenna.

For example, a patch antenna may be mounted in the unmanned aerial vehicle 300 for the beam pattern. According to an embodiment, as the electronic device 200 is mounted in the unmanned aerial vehicle 300, the weight of the mounted antenna may be reduced, and hovering time may be increased. In addition, costs may be reduced.

The WiFi antenna of the electronic device 100 may be coupled to the conductive member 210 to form a beam pattern in a down direction or a bi-directional direction. When the operator of the unmanned aerial vehicle 300 is positioned under or horizontally to the unmanned aerial vehicle, the unmanned aerial vehicle 300 may be controlled.

For example, the performance of the WiFi antenna may be increased, by using the cavity structure of the GPS antenna as the coupling element. As the number of WiFi antennas mounted in the unmanned aerial vehicle 300 may be reduced, the weight of the unmanned aerial vehicle 300 may be reduced. The hovering time may be increased.

According to an embodiment, the conductive member of the electronic device 100 may operate as a radiator of a separate antenna. For example, the unmanned aerial vehicle 300 may perform LTE communication using the conductive member of the electronic device 200 of FIG. 2A.

According to one embodiment, an unmanned aerial vehicle (UAV) 300 may include a housing 350 that includes a top surface 350*a* and a bottom surface 350*b*. Referring to FIG. 6A, the top surface 350*a* and the bottom surface 350*b* of the housing 350 are illustrated by way of example. However, the disclosure is not limited thereto, and a portion of the housing 350, which is positioned above the electronic device 200 mounted inside the housing 350 of the unmanned aerial vehicle 300, may be the top surface 350*a* and a portion of the housing 350, which is positioned down the electronic device 200, may be the bottom surface 350*b*. Hereinafter, the electronic device 200 may be referred to as the antenna structure 100.

According to an embodiment, the unmanned aerial vehicle may include a plurality of propulsion systems 360 at least partially provided inside the housing 350. For example, the plurality of propulsion systems 360 may include a propeller and a motor. The processor of the unmanned aerial vehicle 300 may control the rotational speed of the plurality of propulsion systems 360 of the unmanned aerial vehicle 300.

According to an embodiment, the unmanned aerial vehicle may include an antenna structure 100 (e.g., the electronic device 100 of FIG. 1A and the electronic device 200 of FIG. 2A) positioned between the top surface 350*a* and the bottom surface 350*b* inside the housing 350. The antenna structure 100 may be electrically connected with the at least one communication circuit.

According to an embodiment, the antenna structure 100 may be referred to as the electronic device 100 illustrated in FIGS. 1A and TB.

According to an embodiment, the antenna structure 100 may include the first conductive plate 110*a* (e.g., the first conductive plate 110*a* of FIG. 1A) including a first surface 110*a*-1 facing the top surface 350*a* and a second surface 110*a*-2 facing the bottom surface 350*b*. The antenna structure 100 may include a second conductive plate 110*b* (e.g., the second conductive plate 110*b* of FIG. 1A) surrounding a lateral portion of the first conductive plate 110*a*.

According to an embodiment, the antenna structure 100 may include a first antenna pattern 120 (e.g., which may include the first radiation part 120 of FIG. 1A) interposed between the first surface 110*a*-1 and the top surface 350*a* and set to be used for first wireless communication. According to an embodiment, the antenna structure 100 may include a second antenna pattern 130 (e.g., the second radiation part 130 of FIG. 1A) interposed between the second surface 110*a*-2 and the bottom surface 350*a* and set to be used for second wireless communication.

According to an embodiment, the first antenna pattern 120 of the antenna structure 100 may be substantially parallel to the first surface 110*a*-1. According to an embodiment, the second antenna pattern 130 of the antenna structure 100 may be substantially parallel to the second surface 110*a*-2.

For example, the second antenna pattern 130 may be laterally surrounded by the second conductive plate 110*b*. The second conductive plate 110*b* may operate as a radiator through the coupling between the second conductive plate 110*b* and the second antenna pattern 130. For another example, the communication circuit of the unmanned aerial vehicle may perform LTE communication through the second conductive plate 110*b*.

For example, the first distance 'd1' between the first surface 110*a*-1 and the first antenna pattern 120 may be greater than a second distance 'd2' between the second surface 110*a*-2 and the second antenna pattern 130.

According to an embodiment, at least one communication circuit may be provided to be positioned inside the housing 350 or connected to the housing 350. At least one communication circuit may be set to make first wireless communication with the first external device and to make second wireless communication with the second external device.

According to another embodiment, the communication circuit of the unmanned aerial vehicle may be set to make first wireless communication based on GPS or may be set to make second wireless communication based on WiFi.

Figure 6B:
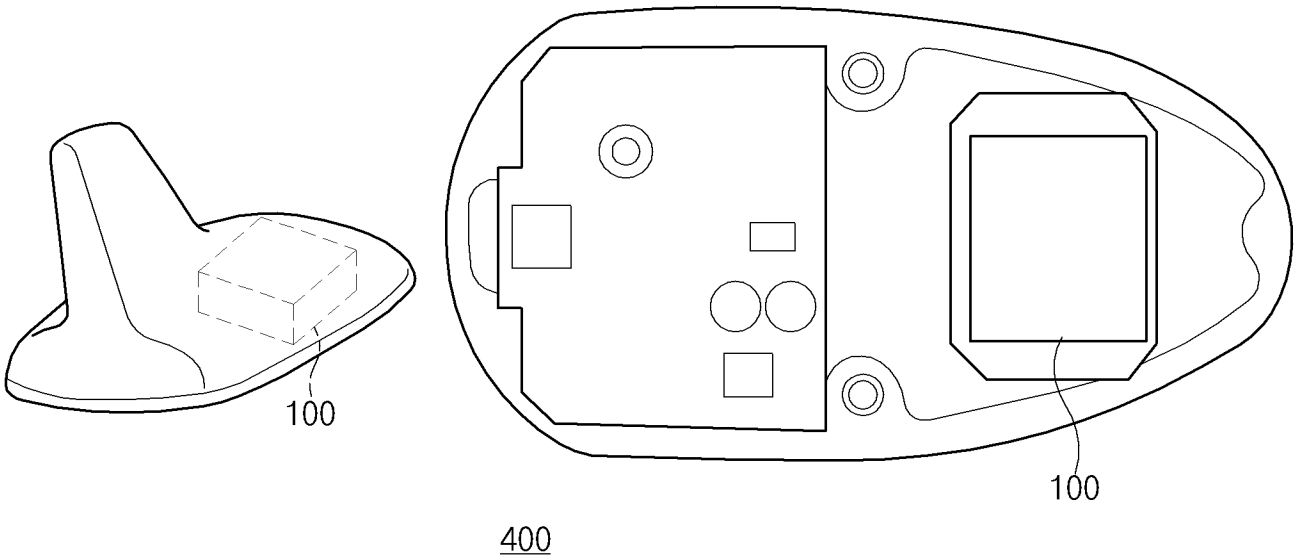
FIG. 6B illustrates an electronic device applied to the vehicle, according to an embodiment.

FIG. 6B illustrates that the electronic device is applied to the vehicle, according to an embodiment.

According to an embodiment, the electronic device 100 (e.g. the electronic device 100 of FIG. 1A or the electronic device of FIG. 6A) may be mounted in a vehicle. For example, the electronic device 100 may be mounted on a vehicle shark antenna. For example, the GPS antenna of the electronic device 200 may form a beam pattern upward through the cavity structure. A satellite may efficiently communicate with the GPS antenna. The WiFi antenna of the electronic device 100 may be coupled to the conductive member 210 to form a beam pattern downward or a bi-directional direction. The electronic device 200 may perform WiFi communication with another electronic device, which allows the WiFi communication, inside the vehicle.

According to various embodiments, an electronic device (e.g., the electronic device 100 of FIG. 1A) may include a conductive member (e.g., the conductive member 110 of FIG. 1A) including a first conductive plate (e.g., the first conductive plate 110*a* of FIG. 1A) and a second conductive plate (e.g., the second conductive plate 110*b* of FIG. 1A) extending from the first conductive plate while forming a first angle with the first conductive plate, wherein the first conductive plate and the second conductive plate form a cavity (e.g., the cavity 150 of FIG. 1A), which is open in a first direction perpendicular to the first conductive plate.

According to various embodiment, the electronic device (e.g., the electronic device 100 of FIG. 1A) may include a first radiation part (e.g., the first radiation part 120 of FIG. 1A) spaced in the first direction from the first conductive plate by a first distance, a second radiation part (e.g., the second radiation part 130 of FIG. 1A) spaced in a second direction, which is opposite to the first direction, from the first conductive plate by a second distance, at least one wireless communication circuit to feed power to the first radiation part and the second radiation part, and a processor electrically connected to the wireless communication circuit.

According to various embodiments, the processor of the electronic device (e.g., the electronic device 100 of FIG. 1A) may be configured to allow the wireless communication circuit to receive a signal having a first frequency having a directionality in the first direction based on the first radiation part and the cavity formed by the conductive member, and to receive a signal having a second frequency signal based on coupling between the second radiation part and at least a portion of the conductive member.

According to various embodiments, the processor of the electronic device (e.g., the electronic device 100 of FIG. 1A) may be configured to allow the wireless communication circuit to receive a multiplied frequency of the second frequency signal based on the coupling between the second radiation part and the at least a portion of the conductive member.

According to various embodiments, the second conductive plate of the electronic device (e.g., the electronic device 100 of FIG. 1A) may extend in the second direction from the first conductive plate, while forming a second angle with the first conductive plate.

According to various embodiments, the processor of the electronic device (e.g., the electronic device 100 of FIG. 1A) may be configured to the wireless communication circuit to receive a signal having the second frequency band through the second conductive plate of the at least a portion of the conductive member coupled to the second radiation part.

According to various embodiments the first radiation part of the electronic device (e.g., the electronic device 100 of FIG. 1A) may include a first conductive pattern, the second radiation part may include a second conductive pattern, and the wireless communication circuit may feed power to the first conductive pattern and the second conductive pattern.

According to various embodiments, the first radiation part of the electronic device (e.g., the electronic device 100 of FIG. 1A) may be coupled to the conductive member through a first support member (e.g., the first support member 113*a* of FIG. 1A), and the second radiation part may be coupled to the conductive member through a second support member (e.g., the second support member 113*b* of FIG. 1A).

According to various embodiments, the first support member and the second support member of the electronic device (e.g., the electronic device 100 of FIG. 1A) may include a non-conductive material, the first radiation part may be spaced apart from the first conductive plate by the first distance through the first support member, the second radiation part may be spaced apart from the first conductive plate by the second distance through the second support member, the first radiation part and the second radiation part may be electrically connected to the wireless communication circuit through a cable including a power feeding path and a grounding path.

According to various embodiments, the processor of the electronic device (e.g., the electronic device 100 of FIG. 1A) may be configured to allow the wireless communication circuit to support GPS communication through the first radiation part, and support WiFi communication through the second radiation part.

According to various embodiments, the second frequency (e.g., the electronic device 100 of FIG. 1A) may include 2.4 GHz, and the multiplied frequency of the second frequency includes 900 MHz.

According to various embodiments, the processor of the electronic device (e.g., the electronic device 100 of FIG. 1A) is configured to allow the wireless communication circuit to support LTE communication based on the coupling between the second radiation part and the at least a portion of the conductive member.

According to various embodiments, an electronic device (e.g., the electronic device 200 of FIG. 2A) may include a first conductive plate (e.g., the first conductive plate 210*a* of FIG. 2A) and a second conductive plate (e.g., the second conductive plate 210*b* of FIG. 2A) extending from the first conductive plate while forming a first angle with the first conductive plate, in which the first conductive plate and the second conductive plate form a cavity open in the first direction perpendicular to the first conductive plate, a first conductive pattern (e.g., the first conductive pattern 220*a* of FIG. 2A) and a second conductive pattern (e.g., the second conductive pattern 220*b* of FIG. 2A) spaced the first direction from the conductive plate by a first distance, a third conductive pattern (e.g., the third conductive pattern 230*a* of FIG. 2A) and a fourth conductive pattern (e.g., the fourth conductive pattern 230*b* of FIG. 2A) spaced in the second direction, which is an opposite direction of the first direction, from the first conductive plate, at least one wireless communication circuit to feed power to the first conductive pattern and the third conductive pattern, and a processor electrically connected to the wireless communication circuit. The processor may allow the wireless communication circuit to receive a signal having a first frequency having a directionality in the first direction based on the first conductive pattern and the second conductive pattern, and the cavity formed by the conductive member, and receive a signal having a second frequency based on coupling between the third conductive pattern and the fourth conductive pattern, and at least a portion of the conductive member.

According to various embodiments, the first conductive pattern and the second conductive pattern of the electronic device (e.g., the electronic device 200 of FIG. 2A) are formed on a first non-conductive plane (E.g., the first non-conductive plane 225 of FIG. 2A), and the third conductive pattern and the fourth conductive pattern may be formed on the second non-conductive plane (e.g., the second non-conductive plane 235 of FIG. 2A).

According to various embodiments, the first non-conductive plane of the electronic device (e.g., the electronic device 200 of FIG. 2A) is coupled to the conductive member through the first support member coupled to the first conductive plate in the first direction, and the second non-conductive plane may be coupled to the conductive member through the second support member coupled to the first conductive plate in the second direction.

According to various embodiments, the unmanned aerial vehicle (e.g., the unmanned aerial vehicle 300 of FIG. 6A) may include a housing (e.g., the housing 300 of FIG. 6A) including a top surface (e.g., the top surface 350*a* of FIG. 6A) and a bottom surface (e.g., the bottom surface 350*b* of FIG. 6A), at least one communication circuit to make first wireless communication with the first external device, make second wireless communication, positioned inside the housing, or connected to the housing, a plurality of propulsion systems (e.g., the propulsion system 360 of FIG. 6A) connected to the housing or at least partially embedded in the housing, a navigation circuit to control the plurality of propulsion systems, and an antenna structure (e.g., the antenna structure 100 of FIG. 6A) positioned between the top surface and the bottom surface inside the housing and electrically connected to the communication circuit. The antenna structure includes a first conductive plate (e.g., the first conductive plate 110*a* of FIG. 6A) including a first surface (the first surface 110*a*-1 of FIG. 6A) facing the top surface and a second surface (e.g., the second surface 110*a*-2 of FIG. 6A) facing the bottom surface, a second conductive plate (e.g., the second conductive plate 110*b* of FIG. 6A) to surround the lateral portion of the first conductive plate, a first antenna pattern (e.g., the first antenna pattern 120 of FIG. 6A) interposed between the first surface and the top surface and used for the first wireless communication, and a second antenna pattern (e.g., the second antenna pattern 120 of FIG. 6A) interposed between the second surface and the bottom surface and used for second wireless communication.

According to various embodiments, in the unmanned aerial vehicle (e.g., the unmanned aerial vehicle 300 of FIG. 6A), the communication circuit may perform the first wireless communication based on GPS.

According to various embodiments, the communication circuit of the unmanned aerial vehicle (e.g., the unmanned aerial vehicle 300 of FIG. 6A) may perform the first wireless communication based on WiFi.

According to various embodiments, the first antenna pattern of the unmanned aerial vehicle (e.g., the unmanned aerial vehicle 300 of FIG. 6A) may substantially parallel to the first surface.

According to various embodiments, the second antenna pattern of the unmanned aerial vehicle (e.g., the unmanned aerial vehicle 300 of FIG. 6A) may substantially parallel to the second surface.

According to various embodiments, the second antenna pattern of the unmanned aerial vehicle (e.g., the unmanned aerial vehicle 300 of FIG. 6A) may be laterally surrounded by the second conductive plate.

According to various embodiments, in the unmanned aerial vehicle (e.g., the unmanned aerial vehicle 300 of FIG. 6A), the first distance between the first surface and the first antenna pattern may be greater than the second distance between the second surface and the second antenna pattern.

Various embodiments of the disclosure and terms used herein are not intended to limit the technologies described in the disclosure to specific embodiments, and it should be understood that the embodiments and the terms include modification, equivalent, and/or alternative on the corresponding embodiments described herein. With regard to description of drawings, similar components may be marked by similar reference numerals. The terms of a singular form may include plural forms unless otherwise specified. In the disclosure disclosed herein, the expressions "A or B", "at least one of A and/or B", "A, B, or C", or "at least one of A, B, and/or C", and the like used herein may include any and all combinations of one or more of the associated listed items. Expressions such as "first," or "second," and the like, may express their components regardless of their priority or importance and may be used to distinguish one component from another component but is not limited to these components. When an (e.g., first) component is referred to as being "(operatively or communicatively) coupled with/to" or "connected to" another (e.g., second) component, it may be directly coupled with/to or connected to the other component or an intervening component (e.g., a third component) may be present.

According to the situation, the expression "adapted to or configured to" used herein may be interchangeably used as, for example, the expression "suitable for", "having the capacity to", "changed to", "made to", "capable of" or "designed to" in hardware or software. The expression "a device configured to" may mean that the device is "capable of" operating together with another device or other parts. For example, a "processor configured to (or set to) perform A, B, and C" may mean a dedicated processor (e.g., an embedded processor) for performing corresponding operations or a generic-purpose processor (e.g., a central processing unit (CPU) or an application processor (AP)) which performs corresponding operations by executing one or more software programs which are stored in a memory device.

The term "module" used herein may include a unit, which is implemented with hardware, software, or firmware, and may be interchangeably used with the terms "logic", "logical block", "part", "circuit", or the like. The "module" may be a minimum unit of an integrated part or a part thereof or may be a minimum unit for performing one or more functions or a part thereof. The "module" may be implemented mechanically or electronically and may include, for example, an application-specific IC (ASIC) chip, a field-programmable gate array (FPGA), and a programmable-logic device for performing some operations, which are known or will be developed.

At least a part of an apparatus (e.g., modules or functions thereof) or a method (e.g., operations) according to various embodiments may be, for example, implemented by instructions stored in a computer-readable storage media in the form of a program module. The instruction, when executed by a processor (e.g., the processor of FIG. 1A), may cause the processor to perform a function corresponding to the instruction. The computer-readable recording medium may include a hard disk, a floppy disk, a magnetic media (e.g., a magnetic tape), an optical media (e.g., a compact disc read only memory (CD-ROM) and a digital versatile disc (DVD), a magneto-optical media (e.g., a floptical disk)), an embedded memory, and the like. The one or more instructions may contain a code made by a compiler or a code executable by an interpreter.

Each component (e.g., a module or a program module) according to various embodiments may be composed of single entity or a plurality of entities, a part of the above-described sub-components may be omitted, or other sub-components may be further included. Alternatively or additionally, after being integrated in one entity, some components (e.g., a module or a program module) may identically or similarly perform the function executed by each corresponding component before integration. According to various embodiments, operations executed by modules, program modules, or other components may be executed by a successive method, a parallel method, a repeated method, or a heuristic method, or at least one part of operations may be executed in different sequences or omitted. Alternatively, other operations may be added.

The invention claimed is:

1. An electronic device comprising:

a conductive member including a first conductive plate and a second conductive plate extending from the first conductive plate while forming a first angle with the first conductive plate, wherein the first conductive plate and the second conductive plate form a cavity, which is open in a first direction perpendicular to the first conductive plate;

a first radiation part spaced in the first direction from the first conductive plate by a first distance;

a second radiation part spaced in a second direction, which is opposite to the first direction, from the first conductive plate by a second distance, the second distance being a value allowing the second radiation part to be coupled to the conductive member, and the second radiation part coupled to the conductive member;

at least one wireless communication circuit configured to feed power to the first radiation part and the second radiation part; and a processor electrically connected to the wireless communication circuit, wherein the processor is configured to allow the wireless communication circuit to:

receive a signal having a first frequency having a directionality in the first direction based on the first radiation part and the cavity formed by the conductive member operating as a reflector for the first radiation part; and receive a signal having a second frequency based on electromagnetic coupling between the second radiation part and at least a portion of the conductive member.

2. The electronic device of claim 1, wherein the processor is configured to allow the wireless communication circuit to:

receive signals in multiple harmonic frequencies of the second frequency based on the electromagnetic coupling between the second radiation part and the at least a portion of the conductive member.

3. The electronic device of claim 2, wherein the processor is configured to allow the wireless communication circuit to:

support GPS communication through the first radiation part; and support WiFi communication through the second radiation part.

4. The electronic device of claim 3, wherein the second frequency includes 900 MHz, and wherein the multiple harmonic frequencies of the second frequency includes 2.7 GHz.

5. The electronic device of claim 3, wherein the processor is configured to allow the wireless communication circuit to:

support LTE communication based on the electromagnetic coupling between the second radiation part and at least the portion of the conductive member.

6. The electronic device of claim 1, wherein the second conductive plate extends in the second direction from the first conductive plate, while forming a second angle with the first conductive plate.

7. The electronic device of claim 1, wherein the processor is configured to allow the wireless communication circuit to:

receive a signal having the second frequency through the second conductive plate of the portion of the conductive member electromagnetically coupled to the second radiation part.

8. The electronic device of claim 1, wherein the first radiation part includes a first conductive pattern, wherein the second radiation part includes a second conductive pattern, and wherein the wireless communication circuit feeds power to the first conductive pattern and the second conductive pattern.

9. The electronic device of claim 1, wherein the first radiation part is coupled to the conductive member through a first support member, and wherein the second radiation part is coupled to the conductive member through a second support member.

10. The electronic device of claim 9, wherein the first support member and the second support member include a non-conductive material, wherein the first radiation part is spaced apart from the first conductive plate by the first distance through the first support member, wherein the second radiation part is spaced apart from the first conductive plate by the second distance through the second support member, and wherein the first radiation part and the second radiation part are electrically connected to the wireless communication circuit through a cable including a power feeding path and a grounding path.

11. The electronic device of claim 1, wherein the first radiation part includes a first conductive pattern and a second conductive pattern, wherein the second radiation part includes a third conductive pattern and a fourth conductive pattern, and wherein the at least one wireless communication circuit feeds power to the first conductive pattern and the third conductive pattern.

12. The electronic device of claim 11, wherein the first conductive pattern and the second conductive pattern are formed on a first non-conductive plane coupled to the conductive member, and wherein the third conductive pattern and the fourth conductive pattern are formed on a second non-conductive plane coupled to the conductive member.

13. The electronic device of claim 12, wherein the first non-conductive plane is coupled to the conductive member through a first support member coupled to the first conductive plate in the first direction, and the second non-conductive plane is coupled the conductive member through a second support member coupled to the first conductive plate in the second direction.

14. The electronic device of claim 11, wherein the first conductive pattern and the second conductive pattern include at least one slit.

15. The electronic device of claim 1, wherein the first distance is longer than the second distance, such that electromagnetic coupling exists between the second radiation part and at least the portion of the conductive member, but electromagnetic coupling is absent between the first radiation part and at least the portion of the conductive member.

16. The electronic device of claim 1, wherein the electromagnetic coupling between the second radiation part and at least the portion of the conductive member induces signals in a harmonic frequency of the second frequency, and wherein the harmonic frequency is within 12.5% of the second frequency.

* * * * *